US008277251B2

(12) United States Patent
Liu et al.

(10) Patent No.: US 8,277,251 B2
(45) Date of Patent: Oct. 2, 2012

(54) ELECTRICAL CONNECTOR ASSEMBLY WITH IMPROVED PCB ENGAGING WITH A CASE

(75) Inventors: Heng Liu, ShenZhen (CN); Xian-Kui Shi, ShenZhen (CN); Yi Zhou, ShenZhen (CN); Chung-Yen Yang, TuCheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 437 days.

(21) Appl. No.: 12/586,151

(22) Filed: Sep. 16, 2009

(65) Prior Publication Data

US 2010/0075544 A1 Mar. 25, 2010

(30) Foreign Application Priority Data

Sep. 16, 2008 (CN) ..... 2008 2 0302137 U

(51) Int. Cl.
*H01R 13/648* (2006.01)

(52) U.S. Cl. ..... 439/607.04; 439/701; 439/76.1

(58) Field of Classification Search ..... 439/701, 439/660, 594, 599, 707, 607.28, 607.58
See application file for complete search history.

(56) References Cited

U.S. PATENT DOCUMENTS

| | | | | |
|---|---|---|---|---|
| 6,055,157 | A * | 4/2000 | Bartilson | 361/699 |
| 6,068,513 | A * | 5/2000 | Cameron et al. | 439/620.04 |
| 6,210,216 | B1 | 4/2001 | Tso-Chin et al. | |
| 6,939,174 | B2 * | 9/2005 | Wu | 439/607.05 |
| 7,000,478 | B1 * | 2/2006 | Zwollo et al. | 73/708 |
| 7,074,083 | B2 * | 7/2006 | Hyland | 439/607.01 |
| 7,247,046 | B1 * | 7/2007 | Wu | 439/490 |
| 7,263,891 | B2 * | 9/2007 | Oda | 73/715 |
| 7,390,197 | B2 * | 6/2008 | Merz | 439/76.1 |
| 8,023,287 | B2 * | 9/2011 | Tachikawa et al. | 361/826 |
| 8,052,430 | B2 * | 11/2011 | Wu | 439/76.1 |
| 2005/0112921 | A1 * | 5/2005 | Lin et al. | 439/98 |
| 2010/0075544 | A1 * | 3/2010 | Liu et al. | 439/701 |

* cited by examiner

*Primary Examiner* — Michael Zarroli
(74) *Attorney, Agent, or Firm* — Wei Te Chung; Andrew C. Cheng; Ming Chieh Chang

(57) ABSTRACT

An electrical connector assembly (100) includes a case (1) defining a chamber therein; a connector (2) received in the chamber, the connector having a metallic shell (22); a printed circuit board (23) enclosed in the case, the printed circuit board having main portion and side portion laterally projecting from the main portion, the side portion having a conductive layer (230) on a top surface thereof, and a hole (231) defined in the side portion through the conductive layer, the hole further aligning with a through hole defined in the case; and the metallic shell of the connector soldered to the main portion of the printed circuit board.

8 Claims, 7 Drawing Sheets

ELECTRICAL CONNECTOR ASSEMBLY WITH IMPROVED PCB ENGAGING WITH A CASE

FIELD OF THE INVENTION

The present invention generally relates to an electrical connector assembly, and more particularly to an electrical connector assembly with improved connecting means for grounding.

DESCRIPTION OF PRIOR ART

With the development of technique, electronic devices have become lower profile and multi-function. Accordingly, components thereof, such as connectors should be high-speed, lower profile and simplified. At present, USB ports and Audio Jacks are mostly used I/O ports in the electronic devices. Those ports are usually mounted onto an external case of the electronic device. U.S. Pat. No. 6,210,216 issued to Tso-Chin et al. on Apr. 3, 2001 discloses a kind of electrical connector assembly. The electrical connector assembly includes an insulative casing in which two USB connectors are fixed and electrically connected to the cable. Two bores are defined in a front wall of the casing for rotatably retaining two bolts. A conductive plate associated with each bolt is fixed in the casing having a first section defining a hole through which the bolt extends and a second section resiliently engaging with a conductive shield of the corresponding USB connector. The conductive plate engages with the grounding panel and forms an electrical connection between the shield of the corresponding USB connector and the grounding panel.

However, the conductive plate may make loose contact to the shield of the corresponding USB connector, even separated from each other, which may result in poor anti-EMI effect.

SUMMARY OF THE INVENTION

Accordingly, an object of the present invention is to provide an electrical connector assembly with an improve connecting means for grounding.

In order to achieve the object set forth, an electrical connector assembly in accordance with the present invention comprises a case defining a chamber therein; a connector received in the chamber, the connector having a metallic shell; a printed circuit board enclosed in the case, the printed circuit board having main portion and side portion laterally projecting from the main portion, the side portion having a conductive layer on a top surface thereof, and a hole defined in the side portion through the conductive layer, the hole further aligning with a through hole defined in the case; and the metallic shell of the connector soldered to the main portion of the printed circuit board.

Other objects, advantages and novel features of the invention will become more apparent from the following detailed description when taken in conjunction with the accompanying drawings.

DETAILED DESCRIPTION OF PREFERRED EMBODIMENTS

Reference will now be made in detail to the preferred embodiment of the present invention.

Figure 1:
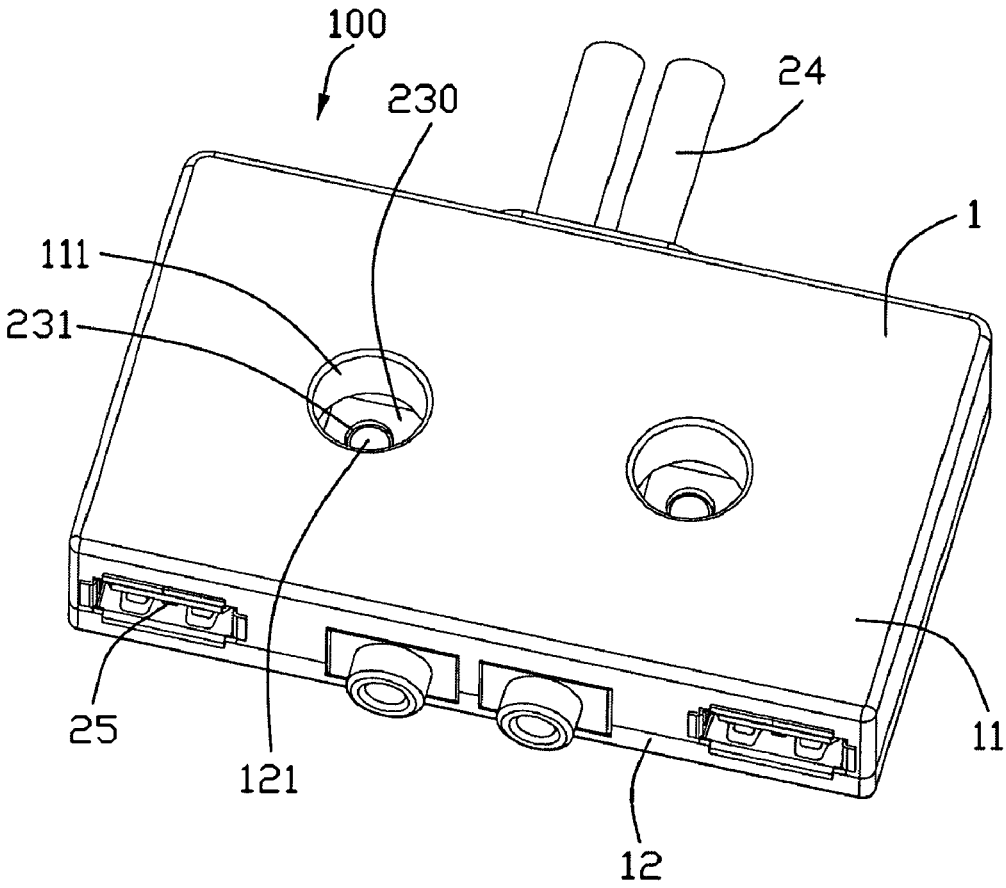
FIG. 1 is an assembled, perspective view of an electrical connector assembly.
Figure 2:
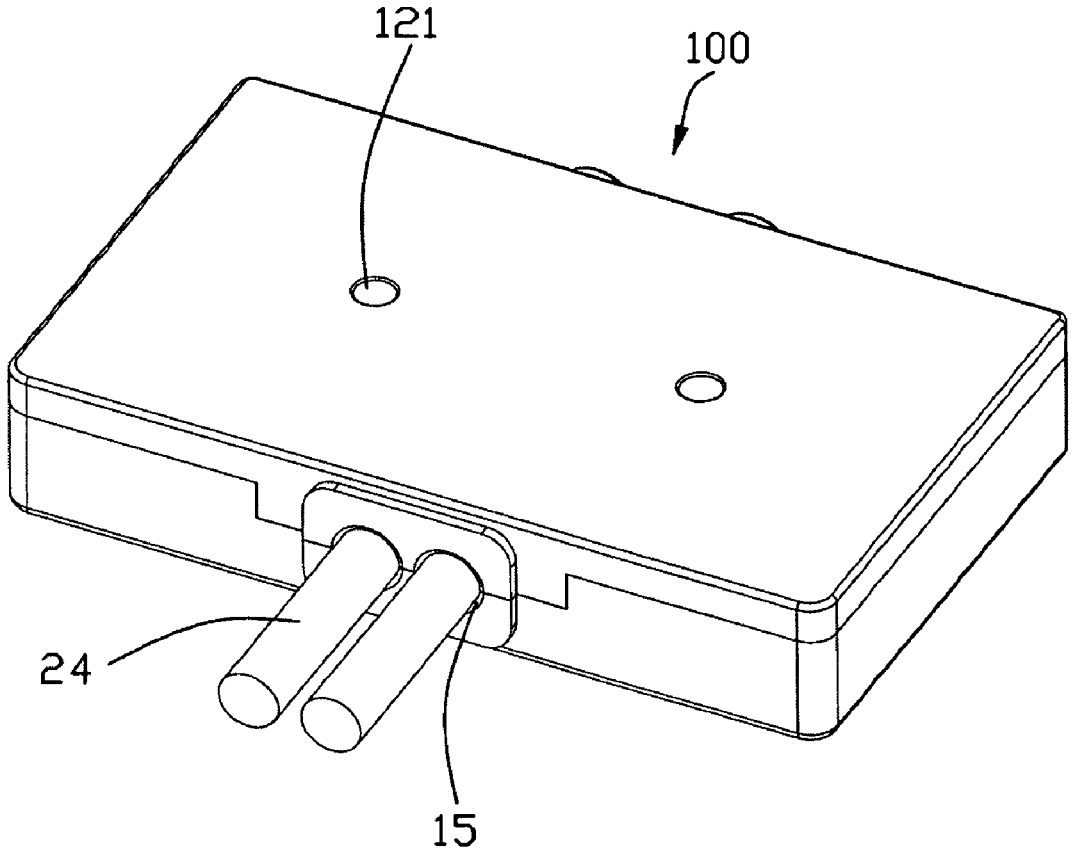
FIG. 2 is similar to FIG. 1, but viewed from another aspect.
Figure 3:
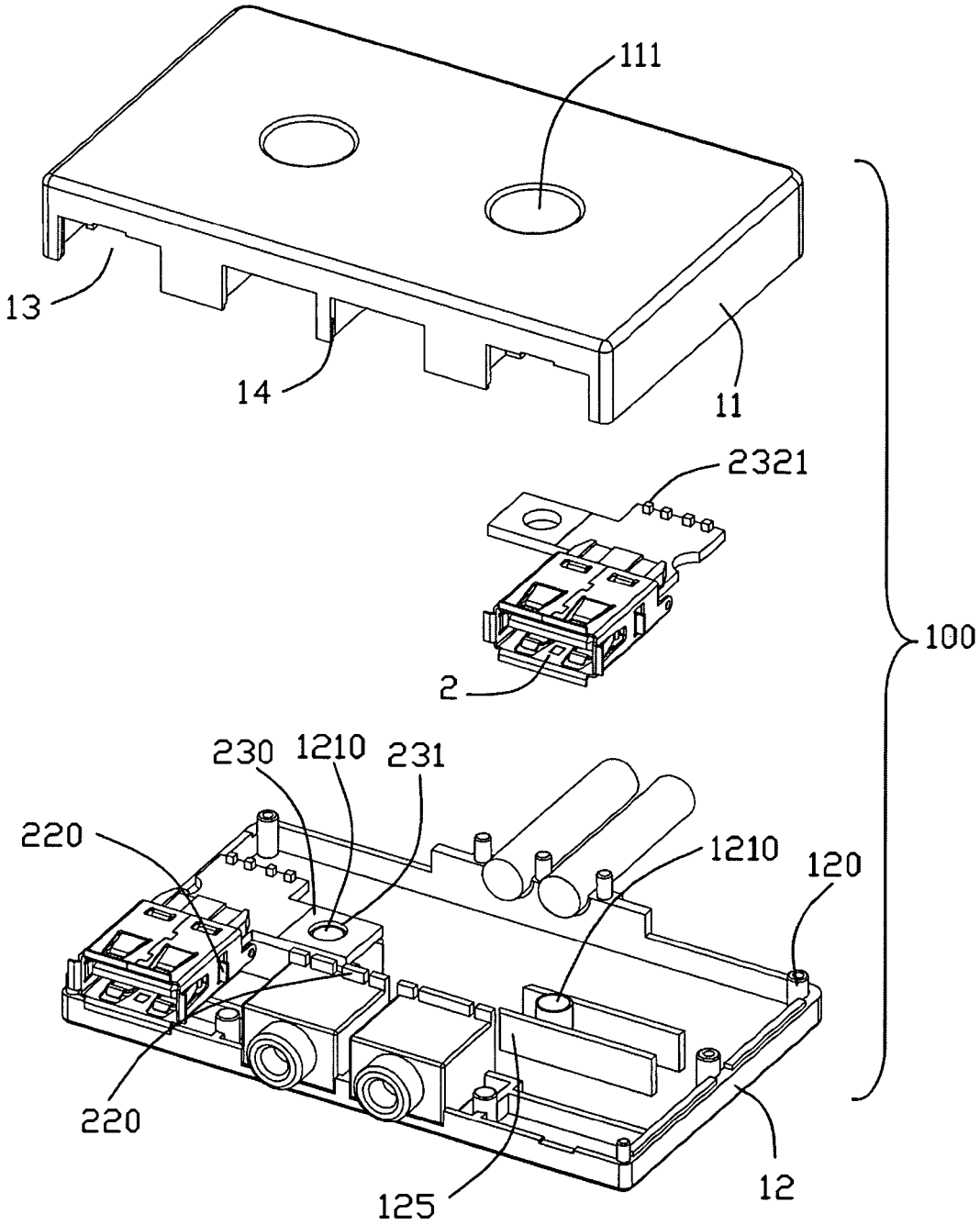
FIG. 3 is an exploded, perspective view of the electrical connector assembly.
Figure 4:
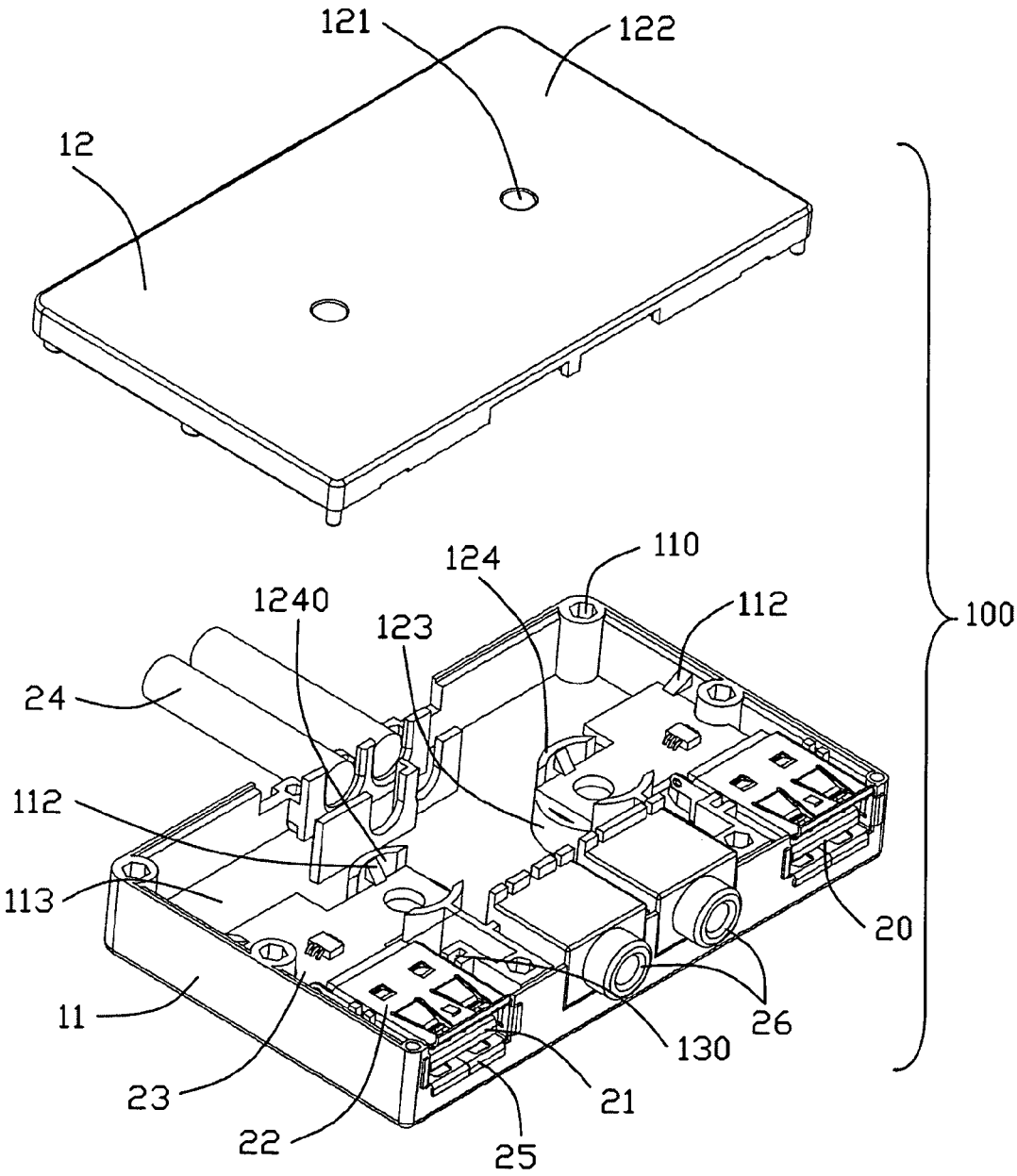
FIG. 4 is similar to FIG. 3, but viewed from other direction.
Figure 5:
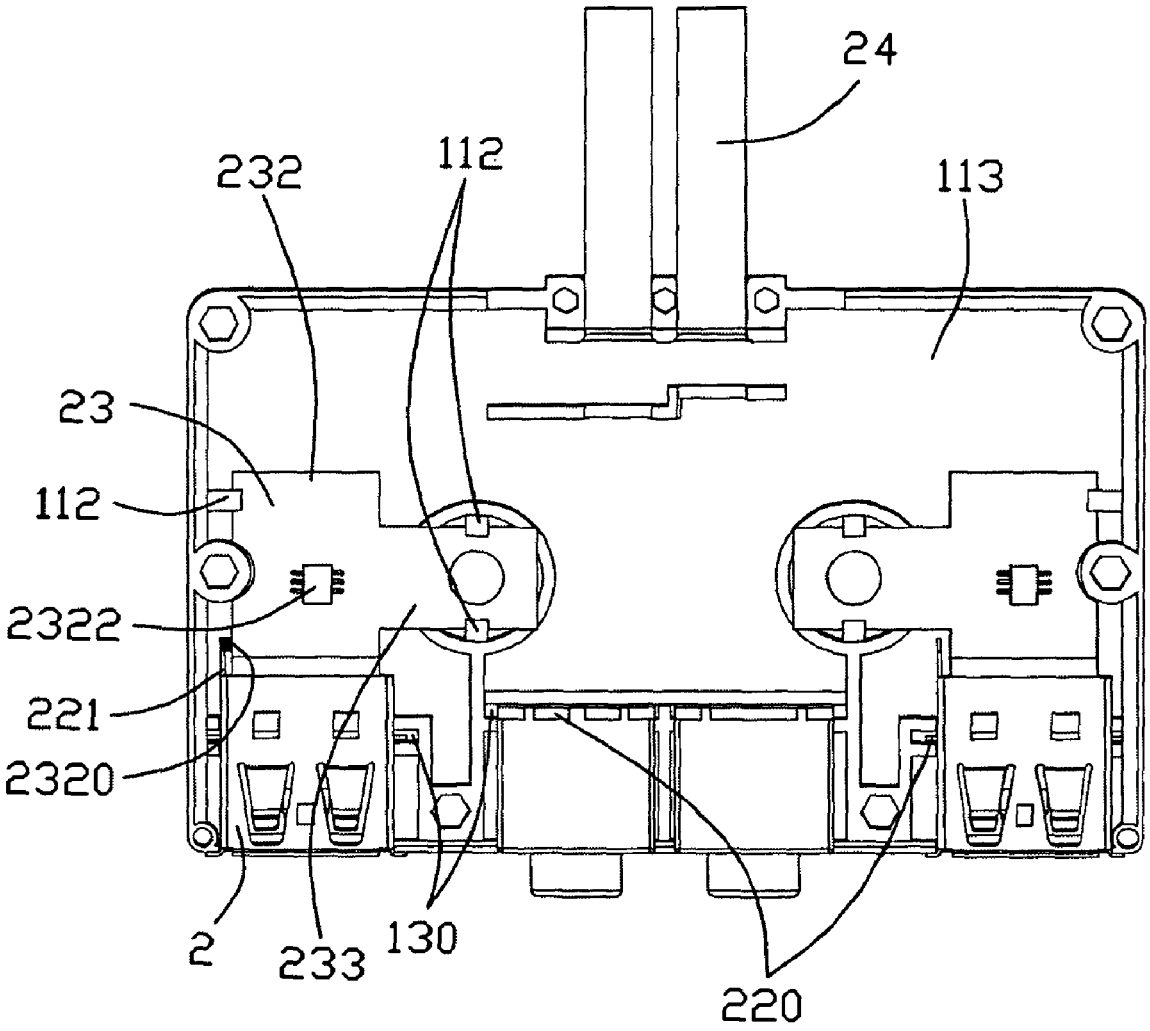
FIG. 5 is a top side view of an interior of the electrical connector assembly.
Figure 6:
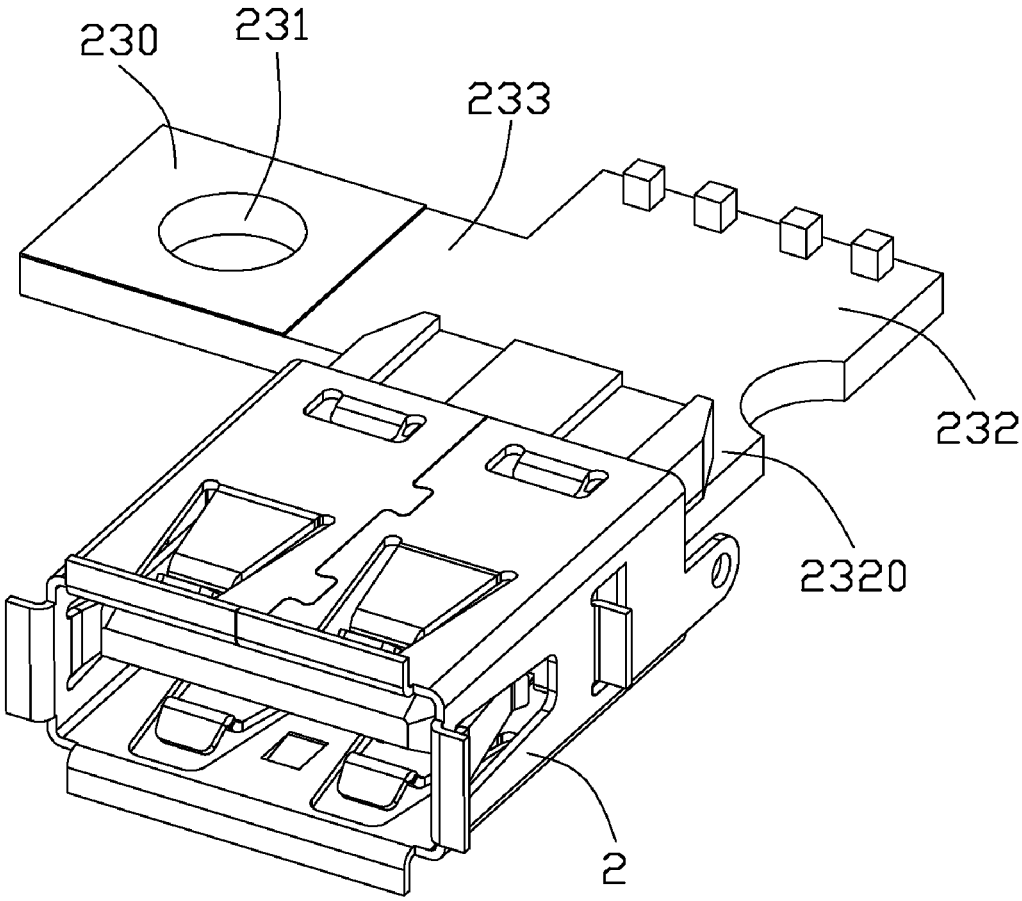
FIG. 6 shows a perspective view of the connector of FIG.1.
Figure 7:
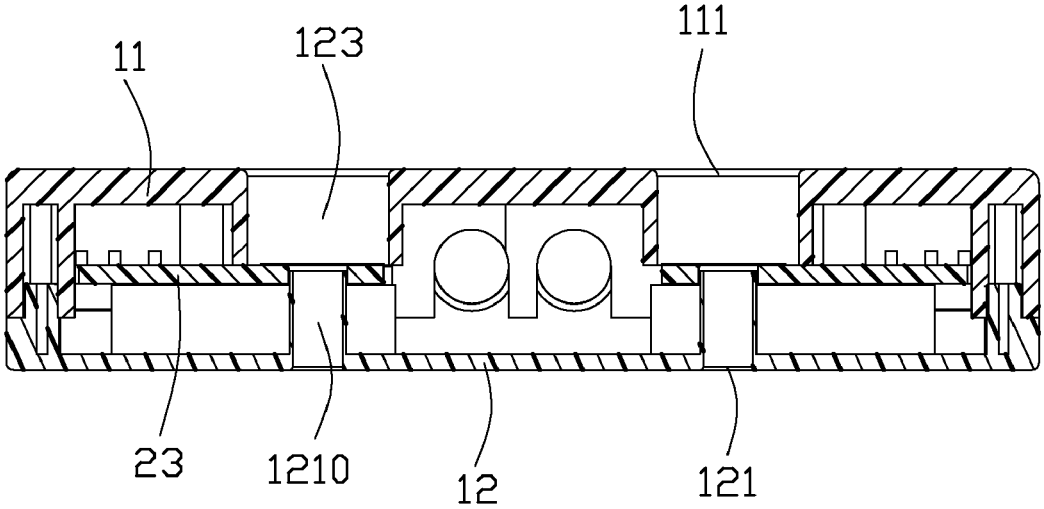
FIG. 7 shows a cross-sectional view of the connector assembly of FIG. 1.

Referring to FIGS. 1-7 , the electrical connector assembly in accordance with the present invention comprises a case 1, a number of connectors 2 enclosed in the case 1 and two cables 4 coupled to the connectors 2.

The case 1 is made of insulative material, and includes an upper cover 11 and a lower cover 12. Four chambers 13 are arranged in the case 1 and disposed in juxtaposed manner. Each chamber 13 has a front opening 14 thereof. Two outlets 15 are defined in a back wall of the case 1. A plurality of posts 120 are formed in an interior of the lower cover 12. A plurality of corresponding cavities 110 is defined in an interior of the upper cover 11 to receive the posts 120 therein. Two first through holes 121 are defined in a middle section of a bottom wall 122 of the lower cover 12, and two second through holes 111 are defined in a top wall 113 of the upper cover 11. The second through holes 111 align with the first through holes 121, respectively. A first cylindrical pipe 1210 extends upwardly from the interior of the low cover 12 and in communication with the first through hole 121. Two board members 125 are respectively disposed in front of and behind the first pipe 1210. A second cylindrical pipe 123 extend downwardly from the interior of the upper cover 11 and in communication with the second through hole 111. The second cylindrical pipe 123 aligns with the first cylindrical pipe 1210 along the vertical direction. Two arc-shaped flanges 124 extend formed on a bottom edge of the pipe 123. The two flanges 124 are spaced apart from each other along a front-to-back direction, with two hooks 112 respectively formed on inner sides 1240 thereof. A number of slots 130 are defined in an up cover 11.

The connectors 2 includes two USB connectors 20 and two audio jacks 26 mounted to the corresponding chambers 13. Each connector 2 includes an insulative housing 21, a metallic shell 22 shielding the insulative housing 21. Each connector 2 has a front port 25 exposed outside of the case 1 via the front opening 14 thereof. A tab 220 projects laterally from the metallic shell 22. A printed circuit board (PCB) 23 is located behind the USB connector 20. The PCB 23 has a T-shaped contour and includes a main portion 232 and side portion 233 laterally projecting from the main portion 232. A tail portion 221 extends backwardly from the metallic shell 22 of the USB connector 20, and the tail portion 221 is soldered to a corresponding conductive portion 2320 located on a top surface of the main portion 232. The side portion 233 is plated with a conductive layer 230 on a top surface thereof. The conductive layer 230 electrically connects with the conductive portion 2320 via an inner trace (not shown). Therefore, the conductive layer 230 and metallic shell 22 form a grounding line. The cable 24 with inner conductors thereof are soldered to conductive pads 2321 being arranged at a back side of the main portion 232. The cable 24 extends outside of the case 1 via outlet 15 thereof. The side portion 233 of the PCB 23 is disposed between the flanges 124 and locked by the hooks 112. A hole 231 is defined in the side portion 233 through the conductive layer 230. The hole 231 further aligns with the through holes 121. The hole 231 is larger than the pipe 1210 such that the pipe 1210 may insert therein. The hole 231 of PCB 2 communicates with the through hole 111.

When assembling, the connectors 2 are respectively mounted to the chambers 13 of the up cover 11, with the front port 25 of each connector 2 disposed around the front opening 14 of the corresponding chamber 13. Each PCB 23 is positioned by some hooks 112 of the case 1. The tabs 220 of the connectors 2 extend into the slots 130 defined in an up cover 11. The cables 24 extend outside the case 1 via the outlets 15 thereof. The low cover 12 is then assembled to the up cover 11. The posts 120 are inserted into corresponding cavities 110. The pipe 1210 is inserted into the corresponding hole 231 of the PCB 23 to position the PCB 23. The through hole 111 of the up cover 11, the hole 231 of the PCB 23 and the through hole 121 of the low cover 12 are aligned with each other along a vertical direction to allow a metallic bolt (not shown) passing through. The metallic bolt has a head portion abutting against the conductive layer 230 of the PCB 23 and a screwed free end passing through a panel (not shown) of an electronic device (not shown), and a nut (not shown) is assembled to the screwed free end of the bolt to fasten the electrical connector assembly to the panel. Thus, a grounding path is formed between the metallic shell 22, the conductive layer 230 of the PCB 23, the bolt and the panel.

An integrate circuit (IC) member 2322 or capacitors mounted to the PCB 23 are utilized for controlling or filtering signals transmitted by connectors 20. Furthermore, a conductive cushion (not shown) can be disposed between the conductive layer 230 and the head of the bolt, therefore, the bolt and the PCB 23 can achieve better electrical connection.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector assembly, comprising:

a case defining a chamber therein, the case having a first pipe extending upwardly from a bottom side thereof and a second pipe extending downwardly from a top side thereof, and the first pipe communicating with a through hole, the second pipe aligning with the first pipe along a vertical direction;

a connector received in the chamber, the connector having a metallic shell;

a printed circuit board enclosed in the case, the printed circuit board having a main portion and a side portion laterally projecting from the main portion, the side portion having a conductive layer on a top surface thereof and a hole defined in the side portion through the conductive layer, the hole further aligning with the through hole defined in the case, and the first pipe extending into the hole of the printed circuit board; and the metallic shell of the connector soldered to the main portion of the printed circuit board.

2. The electrical connector assembly as recited in claim 1, wherein the main portion of the printed circuit board has a conductive portion electrically connected to the conductive layer, and the metallic shell of the connector has a tail portion soldered to the conductive portion.

3. The electrical connector assembly as recited in claim 1, wherein two flanges extend downwardly from the second pipe, and the side portion of the printed circuit board is disposed between the two flanges.

4. The electrical connector assembly as recited in claim 3, wherein at least one hook is formed on an inner side of the corresponding flange to secure the side portion of the printed circuit board.

5. An electrical connector assembly, comprising:

a case having an upper cover and a lower cover, the upper cover having a first pipe formed on interior thereof and in communication with an exterior thereof, the lower cover having a second pipe formed on interior thereof and in communication with an exterior thereof;

at least one connector enclosed in the case, the connector having a metallic shell; and a printed circuit board enclosed in the case, the printed circuit board having T-shaped contour, the metallic shell of the connector soldered to a front segment of the printed circuit board, and a rear segment of the printed circuit board adapted for being soldered to a cable, and a lateral segment with a conductive layer thereon; and a hole defined in the lateral segment of the printed circuit board, the first pipe and the second pipe aligning with the hole of the printed circuit board.

6. The electrical connector assembly as recited in claim 5, wherein the first pipe is inserted into the hole of the printed circuit board.

7. The electrical connector assembly as recited in claim 5, the lateral segment of the printed circuit board extends into the other pipe.

8. The electrical connector assembly as recited in claim 7, wherein the lateral segment of the printed circuit board is secured by at least one hook formed on inner side of the second pipe.

* * * * *